US007251977B2

(12) United States Patent
Mondiere

(10) Patent No.: US 7,251,977 B2
(45) Date of Patent: Aug. 7, 2007

(54) TEMPER ROLLING MACHINE OF A METAL BAND

(75) Inventor: André Mondiere, Saint Jean Bonnefonds (FR)

(73) Assignee: Siemens Vai Metals Technologies SAS, Saint-Chamond (FR)

( * ) Notice: Subject to any disclaimer, the term of this patent is extended or adjusted under 35 U.S.C. 154(b) by 130 days.

(21) Appl. No.: 11/029,484

(22) Filed: Jan. 6, 2005

(65) Prior Publication Data

US 2005/0172691 A1 Aug. 11, 2005

(30) Foreign Application Priority Data

Jan. 6, 2004 (FR) ..... 04 50021

(51) Int. Cl.
*B21D 1/02* (2006.01)

(52) U.S. Cl. ..... 72/165; 72/241.2; 72/246

(58) Field of Classification Search ..... 72/164, 72/165, 205, 241.2, 246, 249
See application file for complete search history.

(56) References Cited

U.S. PATENT DOCUMENTS 2,091,789 A * 8/1937 Maussnest ..... 72/163
2,963,071 A * 12/1960 Krynytzky ..... 72/160
4,286,451 A * 9/1981 Chang ..... 72/161

FOREIGN PATENT DOCUMENTS

JP 63-149017 * 6/1988

* cited by examiner

*Primary Examiner*—Daniel C. Crane
(74) *Attorney, Agent, or Firm*—Arent Fox LLP

(57) ABSTRACT

The invention relates to a method and a machine for temper rolling a metal band including at least two temper rolling units E, E' each carrying an active cylinder (2) and a set (7, 70) of back-up members mounted rotatably on a transversal chassis (1), and means for displacement vertical of each temper rolling unit (E) between a resting position and a temper rolling position for which the active cylinder is applied to the band while bearing, on the opposite side, on its back-up members (7) whereas each active cylinder (2, 2') may be brought into rotation around its axis, in its position away from the band, at an angular speed corresponding to the running speed of the band.

According to the invention, the driving into rotation of each active cylinder (2) is determined by direct application of a rotational torque on a journal (3) attached removably to one end (31) of the cylinder (2), whereas the angular speed of the active cylinder (2) may be slaved to the running speed of the band M, in order to avoid any risk of slipping at contact and, even, during the temper rolling.

20 Claims, 3 Drawing Sheets

TEMPER ROLLING MACHINE OF A METAL BAND

The invention relates to a temper rolling machine usable, in particular, in a temper rolling installation under traction of a metal band and also covers the method implemented.

In the different sectors of metallurgy and, in particular, for the production of metal sheets, conventionally temper rolling machines are used to eliminate as far as possible the flatness defects appearing after the rolling operation.

As shown schematically on FIG. 1, a temper rolling machine comprises, generally, a number of cylinders mounted rotatably around axes orthogonal to a running direction of the band to be temper rolled and offset longitudinally and in height, in order to define an undulated path of the band which, besides, is put under traction and thus undergoes traction-flexion effects in opposite directions enabling to homogenise the constraints. To this end, such a machine includes, inside a frame not represented on FIG. 1, at least two temper rolling units offset longitudinally, respectively an upper unit E' and a lower unit E, placed respectively above and below the band M as well as mechanic or hydraulic means for controlling vertical displacements of each temper rolling unit, transversally to the running plane of the band, between a temper rolling position and a resting position away from the band.

As shown on FIG. 1, such a machine may contain, for instance, two flexion units F1, F2, comprising each an upper temper rolling unit E' and a lower unit E, a flexion unit T carrying a so-called <<vault corrector>> roll adjustable vertically by a mechanical system and, often, another flexion unit carrying a <<camber>> correction or decambering roll.

Other installation configurations may, however, be used according to the field of application.

Each temper rolling unit comprises a transversal chassis, mobile vertically in the frame and carrying a temper rolling cylinder, called active cylinder, mounted rotatably around an axis transversal to the running direction. For temper rolling, the active cylinder has a small diameter, and must therefore bear upon back-up members composed, most often, of two intermediate rolls lying themselves on three rows of rollers.

The transmission of the loads and the rotational centring are conducted by application of the active cylinders on the intermediate rolls and the bearing rollers which are only attached to the transversal chassis.

Indeed, to obtain the requested flexion-traction effect, the temper rolling active cylinders should have relatively small diameter and rotate therefore at very high speed, which involves relatively rapid wear of their external faces. The active cylinders and, possibly, the intermediate rolls should therefore be replaced periodically.

To do so, a disassembly device is used conventionally, which enables to withdraw the assembly from the temper rolling unit requiring a maintenance to move it away laterally on one side of the machine, whereas the metal band may stay in the machine, either stopped, or when running. Indeed, for simple changing of the active cylinders or any other short maintenance, the temper rolling machine should preferably be stopped to open and process to the replacement of the cylinders without stopping the running of the band in the treatment section.

Such operations should therefore be carried out rapidly and it is why, usually, the active cylinders and the intermediate rolls are simply held at their ends by axial stops, generally, of ceramic material, which take up the axial thrusts appearing during the temper rolling of the band. The assembly should however be mounted to remain interconnected with the transversal chassis in the opening and closing phases of the machine, apart from temper rolling, as well as when handling the chassis.

Until now, temper rolling had been conducted in separate machines, the band being unwound from a coil placed upstream to be re-wound downstream. However, it is now necessary to install temper rolling machines in continuous lines used, in particular, for annealing or heat-galvanisation of the band.

In such lines, the coils are butt-welded at the inlet of the line, the band being re-cut into coils at the outlet. Band accumulators are therefore placed, respectively, upstream and downstream to ensure running at constant speed of the band in a central treatment section during necessary stop at the inlet for welding or at the outlet for cutting. The temper rolling units are, normally, installed in this central section having a substantially constant speed in order to obtain the requested regularity of the quality parameters of the product.

However, the welding between two successive coils constitutes, generally, an excessive thickness which risks damaging the temper rolling cylinders. To avoid this shortcoming, it is preferable to open the temper rolling machine while moving away the temper rolling cylinders as the welded spot passes and bringing it then in contact with the band. The assembly of the active cylinders, of the intermediate rolls and of the back-up rollers is then again driven by friction as the equipment is docking on the band and there results, unavoidably, a slipping due to the rotational inertia of the different cylinders and rollers during some seconds which may, however, correspond to several tens of meters of band, taking into account the running speed.

Generally, in a continuous annealing or hot-galvanisation line, such a slipping is tolerated since the defects by scratching, corrosion pits or the roughness defects which may result therefrom are little visible or at least, not disqualifying for ordinary steels.

However, it is now sought to treat in continuous lines of other types of steels for which the surface is more fragile and its aspect larger, as for instance the stainless steels. Besides, such steels often show reduced friction coefficient, i.e. a reduced capacity to drive by friction the assembly of the cylinders and rollers, which increases the risk of slipping.

To remedy this shortcoming, it has been suggested, in the document JP-A-63-149017, to give beforehand to the active cylinder, in the position away from the temper rolling unit, an angular speed corresponding substantially to the running speed of the band, which enables to avoid slipping during docking. To this end, the document JP-A-63149017 involves driving in rotation the central row of back-up rollers, the latter being mounted on a fluted shaft connected to a motor by a clutch. The rotational movement is then transmitted by friction to the intermediate rolls then to the active cylinder, the rotational speed of the rollers driven being adjusted in order to give to the active cylinder an angular speed corresponding to the running speed of the band, which enables to avoid slipping during docking.

Such an arrangement enables to place the motor and the clutch on the chassis of the temper rolling unit in an away position of the running plane of the band but exhibits certain shortcomings.

Indeed, the rotational torque is transmitted to the active cylinder solely by friction and this effect depends on the application pressure of the members revolving on one another. For the lower unit, this application pressure corresponds simply to the weight of the active cylinder and the intermediate rolls, as long as the active cylinder is not applied to the band.

Conversely, for the upper unit, the active cylinder should be carried, at its ends, by two bearings hanging from the chassis of the unit by springs which draw upwardly the active cylinder in order to apply it to the intermediate rolls and the back-up rollers.

To enable the disassembly of the active cylinder, the springs are connected to the bearings by removable hooks.

Such an arrangement is rather complex and may not always guarantee sufficient application pressure for driving it by friction of the active cylinders at the requested speed.

On the other hand, the angular speed of the back-up rollers whereon is applied the rotational torque should be adjusted relative to the ratio of the diameters of said rollers, of the intermediate rolls and of the active cylinder so that the angular speed thereof corresponds exactly to the running speed of the band. Still, the diameters of these different members may vary slightly due to the wear and this should be taken into account when adjusting the angular speeds. Moreover, such wear is not distributed regularly over the length of the cylinders and, hence, there may exist a slight difference in diameter and, consequently, in the peripheral speed between the successive rollers of the row driven into rotation. This difference implies increased wear of certain portions of the intermediate rolls and of the active cylinders which may produce defects on the band. The objective sought might therefore not be reached.

The invention enables to remedy these various shortcomings thanks to a new arrangement enabling, by very simple means, to drive the active cylinders at an angular speed corresponding surely to the running speed of the product, while keeping a possibility of easy and rapid disassembly and re-assembly of the active cylinders and, if necessary, of the intermediate rolls.

The invention applies therefore, generally, to a temper rolling machine including at least two temper rolling units placed on both sides of the band and including each an active cylinder and a set of back-up members mounted rotatably round their axes on a transversal chassis, the assembly being movable parallel to itself between a resting position for which the active cylinder is moved away from the band and a temper rolling position for which the active cylinder is applied to the band while bearing, on the opposite side, on its back-up members, whereas each active cylinder may be brought into rotation, before application to the band, at an angular speed corresponding substantially to the running speed of the band.

According to the invention, the driving into rotation of each active cylinder is determined by direct application of a rotational torque to one end of said cylinder, at an angular speed slaved to the running speed of the band.

To this end, each active cylinder is carried, at each of its ends, by a centring journal mounted rotatably around the axis of the cylinder, on a supporting part mounted slidingly on the transversal chassis of the unit parallel to a radial plane running through the axis of said active cylinder, whereas the positions with respect to said chassis of both supporting parts may be adjusted by radial sliding for the displacement of the active cylinder, parallel to its axis, between an application position on its back-up members and an away position, and one of the centring journals of each active cylinder is connected to a means for direct application of a rotational torque to said journal.

Particularly advantageously, each supporting part of an active cylinder, includes a first section in the form of a cylindrical casing, wherein is mounted a bearing for rotary support of the active cylinder, centred on a radial plane running through the axis of said cylinder, and a second section forming an arm mounted to slide on a rail arranged on a guiding foot attached to the transversal chassis of the temper rolling unit. Moreover, each supporting sliding part is associated with a recall means bearing, in one direction upon the supporting part and in the other on the transversal chassis, for the application of the active cylinder on its back-up members.

Preferably, each supporting part includes a back-up means on the chassis, composed advantageously of a cam mounted rotatably between at least two positions, respectively an away position of the chassis, enabling the application of the active cylinder on its back-up members, thanks to the recall means bearing on said supporting part and a resting position on the chassis to urge the supporting part against the action of the recall means.

According to a preferred embodiment, each supporting part includes a bearing portion fitted with at least one passage orifice of at least one guiding rod attached by a first end on the transversal chassis and extending, on the other side the bearing portion of the supporting part, up to a second end whereon is provided a bearing flange of a resilient means compressed between said flange and the bearing portion of the supporting part.

According to another preferred characteristic, each supporting part of an active cylinder carries a centring bearing with a rotary internal roll frame wherein is threaded a supporting journal attached to the end of the active cylinder, in the extension thereof, one of both journals being extended outwardly by a driving end cap connected to a means for controlling the rotation of the journal with the active cylinder, around its axis.

Advantageously, each of both supporting journals of the active cylinder forms an end of the shaft fitted, of the active cylinder side, with a removable linking means with the active cylinder, said shaft end being movable axially between a clamped linking position with the cylinder, for the rotational support thereof and an away position, disconnected from the end of the cylinder, for the disassembly thereof, whereas this linking means may be composed of two portions of matching shapes laid out respectively on the journal and the end of the cylinder and engaging into one another by axial displacement of the journal from an away position to a clamped position.

According to another particularly advantageous arrangement, at least the supporting part of the driving journal of each active cylinder is mounted slidingly parallel to a radial plane running through the axis of said cylinder, on a guiding foot interconnected with a skid mounted slidingly on the transversal chassis, parallel to the axis of the active cylinder, between a clamped position of both supporting parts for the engagement of the ends of the active cylinder on the centring bearings and an away clearance position of the ends of the active cylinder, for the disassembly thereof, the transversal chassis being fitted with means for attaching the base of the guiding foot of each supporting part in the clamped engagement position of the ends of the active cylinder on the centring bearings.

Thanks to the arrangements according to the invention, in the resting position of the temper rolling unit, the active cylinder may be moved away from its back-up rolls by both cams, to be dismounted then, after re-assembly between both journals, it is urged by both supporting parts in the opposite direction in order to bear beforehand up on its back-up members. In this position, it is driven into rotation at a peripheral speed corresponding to the running speed of the band, while also driving the back-up members, so that contact may be made with the band, in the temper rolling position, without any risk of slipping and, consequently, of damaging the surface quality of the product.

Still, such application of the active cylinder to its back-up members may be maintained in the resting position of the temper rolling unit, the active cylinder being moved away from its back-up members only if required for disassembly and/or replacement.

Besides, since the rotational torque is applied directly to the active cylinder, the angular rotational speed thereof around its axis may be slaved to the running speed of the band and this, not only in the resting position of the temper rolling unit but also, during the temper rolling, in the working position of the unit.

Thus, any risk of slipping is avoided, not only when coming in contact after stopping the temper rolling, but also during the temper rolling, for instance in case of sudden variation of the running speed in the temper rolling section, the inertia of the rolls and of the back-up rollers being compensated for in that the rotational torque at slaved speed is applied directly to the active cylinder which drives by friction its back-up members.

Other advantageous characteristics included in the protection field of the invention, will appear in the following description of a particular embodiment, given for exemplification purposes and represented on the appended drawings.

Figure 1:
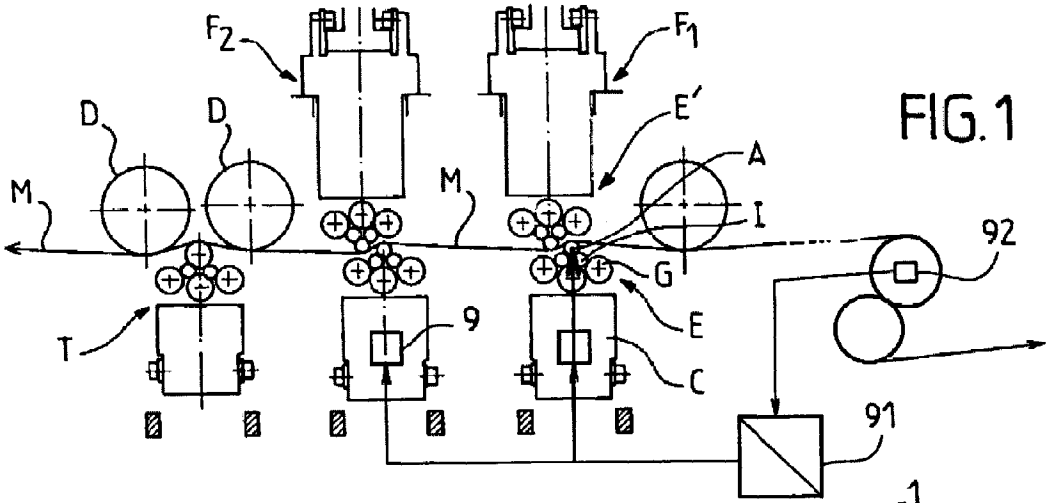
FIG. 1 is a schematic view of the assembly of a temper rolling installation.

As indicated above, FIG. 1 shows schematically the conventional arrangement of a temper rolling installation comprising for instance two flexion units F1-F2 and a vault correction device T, associated with deflector rolls D and adjustable in height, in order to define an undulated path of the band M which runs between the successive rolls according to a longitudinal direction parallel to the plane of FIG. 1.

For the temper rolling process, the band is placed under traction by known means such as tension rolls so-called <<S-rolls>> which are placed upstream and downstream. FIG. 1 shows, for instance, the downstream tension device S.

Each flexion unit comprises two temper rolling units, respectively lower E and upper E' offset longitudinally and including each, conventionally, an active cylinder A associated with two intermediate rolls I which rest on three rows of back-up rollers G when the active cylinder A is applied to the band in the temper rolling position represented on FIG. 1, by vertical displacement of the chassis C, for instance, by dint of jacks or screws not represented.

Figure 2:
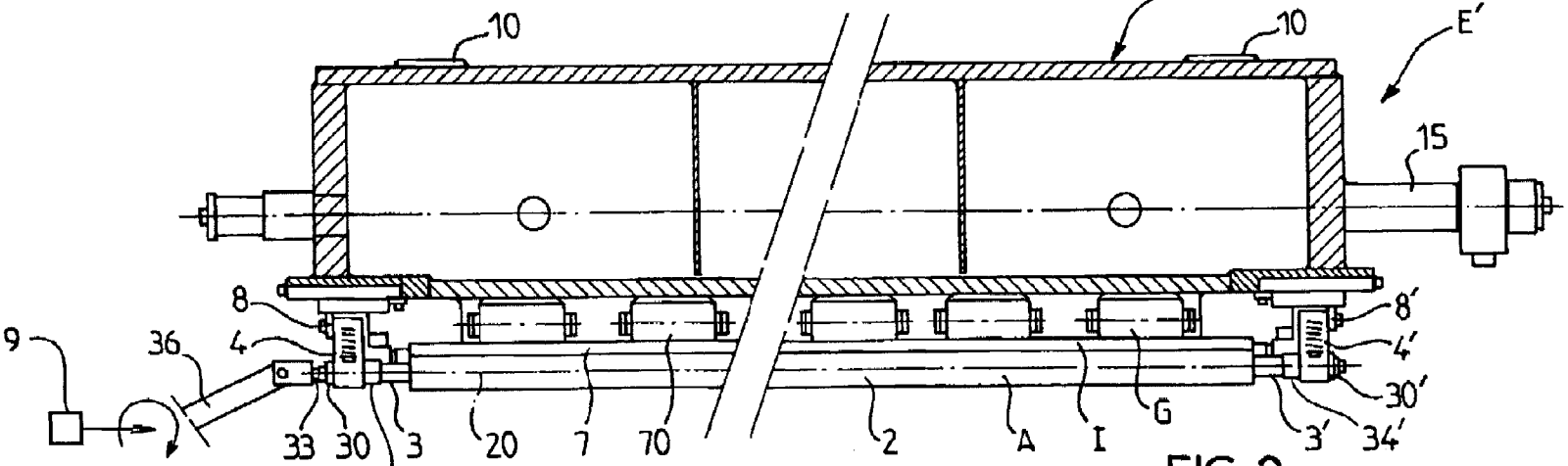
FIG. 2 is an overall side view, of an upper temper rolling unit.

FIG. 2 is a side view of the assembly of the upper temper rolling equipment E' mounted on a transversal chassis 1 forming a resistant beam extending along a direction orthogonal to the running axis of the band and fitted with back-up portions 10 for jacks or thrust screw to apply the temper rolling unit to the band.

Advantageously, in the example represented on FIG. 2, the transversal chassis of the upper unit E' is mounted rotatably around a horizontal axis, according to an arrangement subject matter of the patent FR-A-2 659 254 of the same company, which enables to bring upward the assembly of the unit for easy disassembly and replacement of the cylinders and rolls.

As indicated above, in the arrangements used conventionally, the active cylinder A and the intermediate rolls 1, rest upon one another and on the rollers G only in the temper rolling position and therefore they are carried with a clearance by the transversal chassis C and are only held laterally by axial stops.

Figure 3:
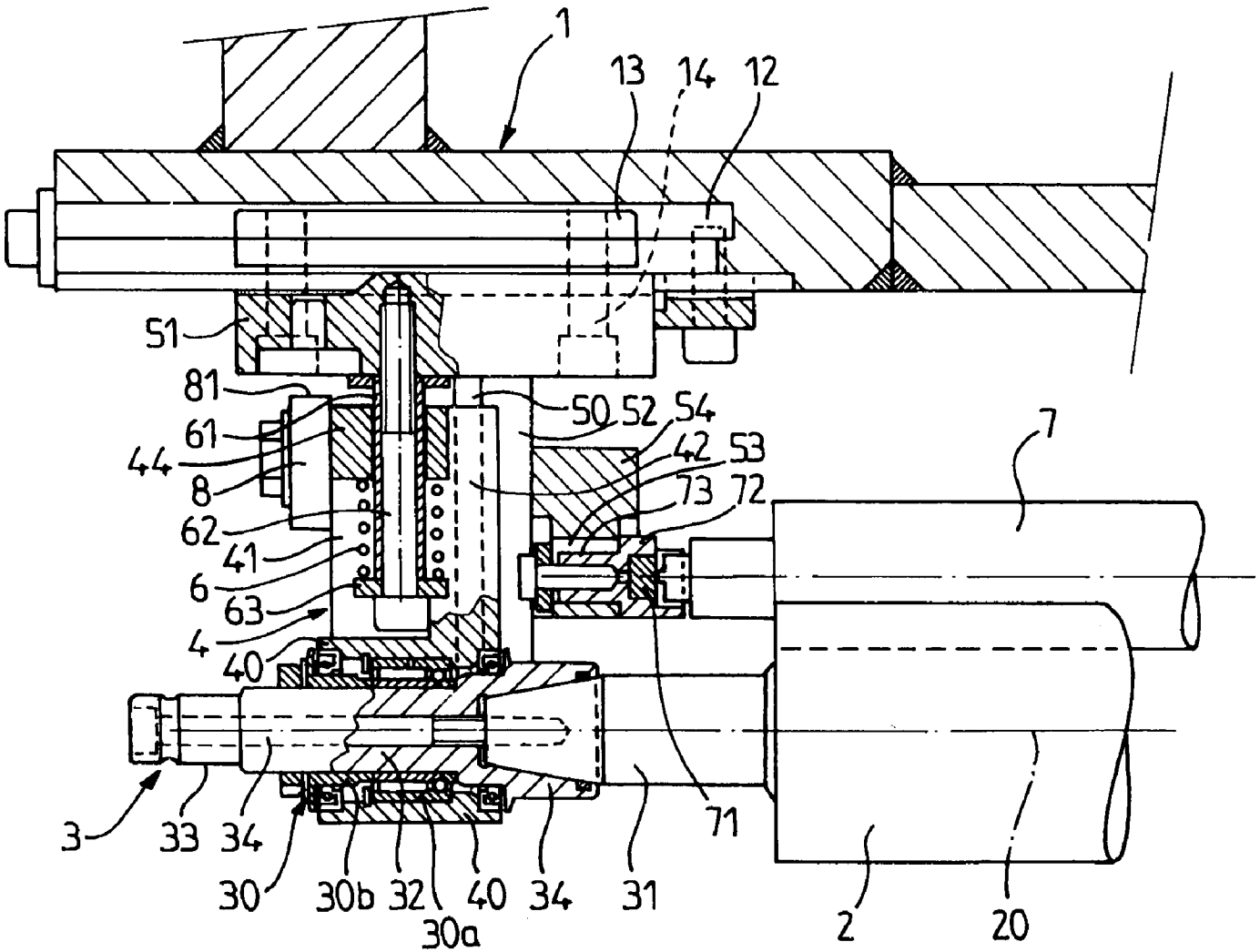
FIG. 3 is a detailed axially sectional view, of one end of the upper temper rolling unit.
Figure 4:
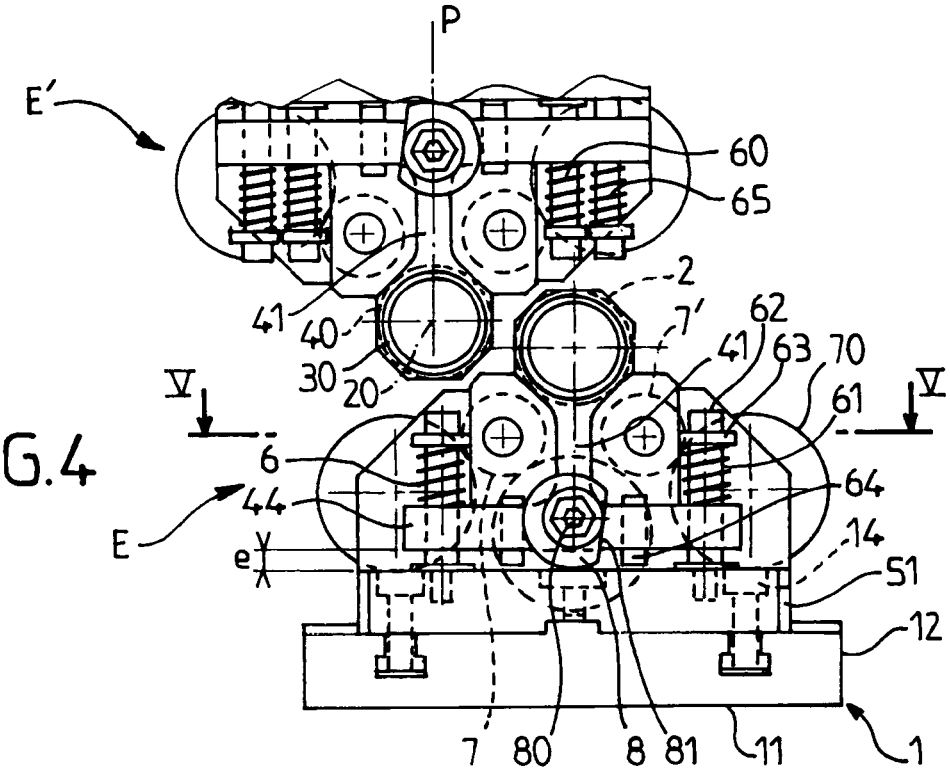
FIG. 4 is a side view of both temper rolling units.
Figure 5:
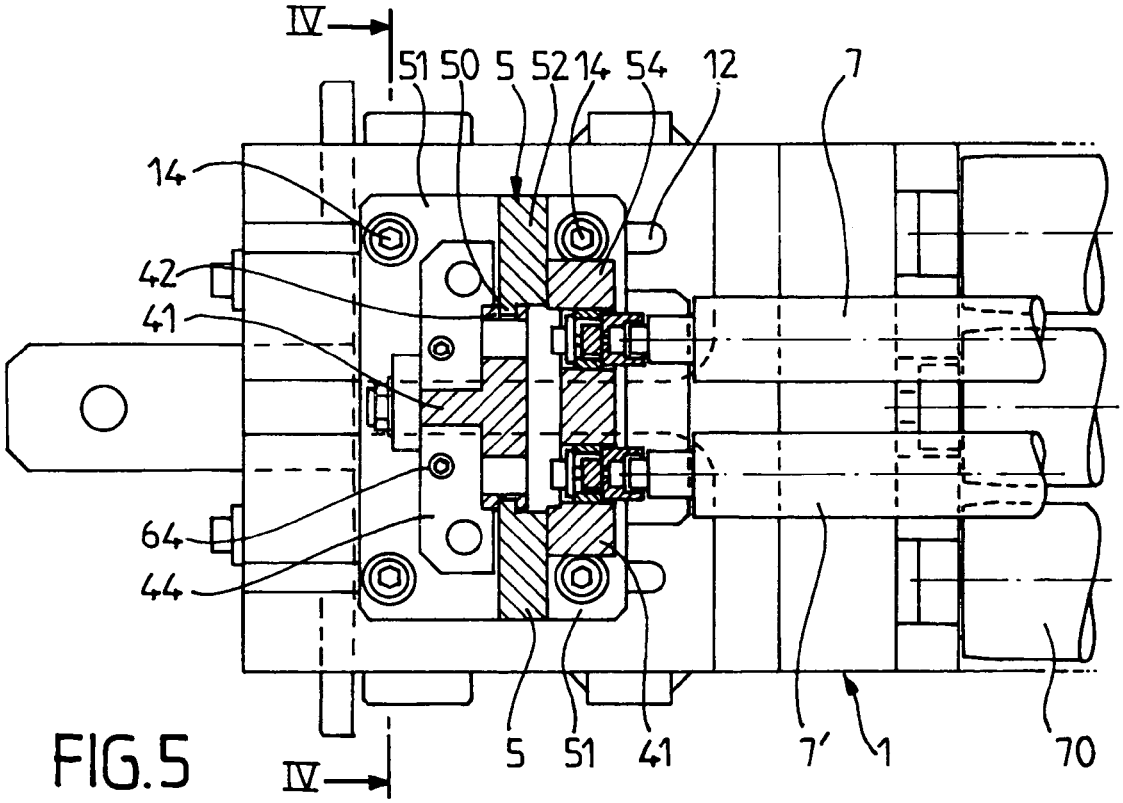
FIG. 5 is a horizontally sectional view along line V-V of FIG. 4.

In the invention, conversely, as shown on FIGS. 2 and 3, the active cylinder 2 is fitted, at its opposite ends, with two journals 3, 3' centred on the axis 20 of the cylinder and mounted rotatably, by means of bearings 30, 30', on two supporting parts 4, 4' as represented moreover in detail on FIGS. 3, 4 and 5.

In this arrangement, each supporting part 4 forms a kind of chock centred on a radial plane P running through the axis 20 of the active cylinder 2 and includes an arm 41 mounted to slide radially on a guiding foot 5 extending towards the band from the chassis 1, and a portion in the form of a casing 40, attached to the end of the arm 41 opposite the chassis, and wherein is inserted the bearing 30 of the journal 3.

On the other hand, each supporting part 4 of one end of the active cylinder 2 is associated with recall means 6 enabling to apply the active cylinder 2 to its back-up members which are composed, in the example represented, of two intermediate rolls 7, 7', held axially between both guiding feet 5, 5' and resting on three rows of back-up rollers 70 mounted rotatably on the transversal chassis 1.

To this end, each supporting part 4, 4' is fitted, on the side to chassis 1, with a sole 44 whereon rest at least two springs 6 spaced symmetrically on both sides of the radial plane P and bearing, in the opposite direction, on the chassis 1.

As shown on FIGS. 4 and 5, each spring 6 is threaded on a socket 61 running in a orifice of the sole 44 of the chock 4 and attached to the chassis 1 by an axial screw 62, the socket 61 including a flange 63 for compressing the spring 6.

Each chock 4, 4' is thus mounted slidingly radially on at least two sockets 61 and urged towards the chassis 1 by the springs 6 compressed between the flanges 63 and the sole 44 which extends parallel to the base 51, at a small distance thereof.

Both chocks 4, 4' supporting the ends of the active roll 2 are thus urged towards the transversal chassis 1 while applying the active cylinder to the intermediate rolls 7, 7' which bear upon the rollers 70.

As conventionally, the intermediate rolls 7 are not carried by bearings but simply held laterally between two axial stops composed each of a ceramic pellet 71 mounted in a casing 72 attached by a rear extension 73 to the guiding foot 5. To this end, the guiding foot 5 includes both spaced stanchions 52 carrying the rails 50, between which extends a crossbeam 54 fitted with two recesses 53 wherein are threaded the extensions 73 of both centring stops 71, respectively, of both intermediate rolls 7, 7'.

Each casing 72 is held by a clamping screw engaging into a threaded bore of the extension 73 which is mounted to slide in the housing 53 parallel to the bisecting plane of both rows of rollers 70 whereon it rests, with a clearance enabling slight adjustments of the intermediate roll.

Thus, when the active cylinder 2 is applied by the springs 6 to the back-up rolls 7, the latter may move slightly, parallel to themselves in order to be applied to the back-up rollers 70.

Besides as stated above, the active cylinder 2 is subjected to a certain wear and should be replaceable. To do so, the bases 51 of both guiding feet 5 carrying both supporting parts 4 are mounted slidingly on the transversal chassis 1, parallel to the axes of the cylinders.

To this end, as shown on FIGS. 4 and 5, each base 51 is fitted with a central groove which engages on a rectilinear emboss 11 of the transversal chassis 1. Moreover, the latter is fitted with two longitudinal housings 12 inside which are mounted slidingly, respectively, two strips 13 connected to the base 51 by screws 14 which enable, after sliding, to lock the base 51 in the position selected.

Besides, each journal 3 of the active cylinder is composed of two portions engaging into one another and interconnected by a screw 34, respectively a pivot pin 31 attached to the end of the active cylinder 2, in the axis thereof, and one end of the shaft 32 threaded in the bearing 30 and, consequently, interconnected axially with the supporting part 4 and the guiding foot 5.

In the preferred embodiment represented on FIG. 3, the pivot pin 31 and the shaft end 32 are fitted with matching conical portions laid out respectively recessed and protruding, and engaging into one another to ensure simultaneously the centring and the driving into rotation of the active cylinder 2, one of the shaft ends 32, for instance the left one on FIG. 3, being fitted with a end cap 33 whereon is applied a rotational torque generating by a motorised means not represented.

However, to enable disassembly of the active cylinder 2, the application pressure thereof on the intermediate rolls 7, 7' should be suppressed.

To this end, each chock 4, 4' of a journal 3, 3' of the active cylinder 2 is equipped with a means for moving away the cylinder composed, in the embodiment represented on the drawing, with a cam 8 with eccentric profile, mounted rotatably on the central groove 41 of the chock 4 around an axis 80. Thus, as shown on FIG. 4, a rotation of the cam eccentric 8 around its axis 80 enables to urge the sole 44 of each supporting part 4, 4' while increasing the compression of the springs 6. The active cylinder 2 being thus slightly spaced from the intermediate rolls 7, 7', it is possible to move aside both guiding feet 5, 5' with the supporting parts 4, 4' in order to release the pivot pins 31 at both ends of the cylinder 2.

Thus, after unlocking the bases 51 while loosening the screws 14 and disconnecting both portions 31, 32 of each journal 3 while loosening the screw 34, both guiding feet 5 may be moved axially with the supporting parts 4, 4' and the bearings 30, 30' which drive the shaft ends 32, 32'.

In the case of lower the temper rolling unit E, represented on FIGS. 3, 4 and 5, the active cylinder 2 thus disconnected of its bearings 30, 30' lies simply on its back-up rolls 7, 7'. It may therefore be easily withdrawn and replaced.

If required, one may also withdraw and replace the intermediate rolls 7, 7' which lie on the back-up rollers 70.

In the case of the upper temper rolling unit E' represented on FIG. 2, it is particularly interesting that the transversal chassis 1 is mounted rotatably around a horizontal axis 15, according to an arrangement which is the subject of the French patent FR 2 659 254 already mentioned. Indeed, before any disassembly operation, it is thus possible to overturn by 180° the upper temper rolling unit E' so that the active cylinder 2 is placed above its back-up members and lies therefore on the latter when shaft ends 32, 32' with the chocks 4, 4' are moved apart.

After replacing the active cylinder 2 and, possibly the intermediate rolls 7, 7', the chocks 4, 4' are tightened so that the conical portions of the pivot pin 31 and of the shaft end 32 engage into one another. The cylinder 2 may then be applied to the intermediate rolls 7, 7' while turning in other direction the eccentric cams8 which are fitted with a plane face 81, in order to enable the springs 6 to urge the sole 44 towards the base 51.

To prevent the cam 8 from being locked, the spacing (e) between the sole 44 and the base 51 is held at a minimum value by adjustable stops 64 composed of screws engaging in threaded bores of the sole 44.

As conventionally, these operations may be carried out on each temper rolling unit, in a maintenance position spaced from the machine and the assembly of the unit, with the transversal chassis, is then put back in working position inside the frame.

Besides, as indicated above, one of both journals of each active cylinder 2, for instance the left-hand journal on FIG. 2, is extended by a driving end cap 33, for instance fluted, which may be connected removably to a motorised means as a reducing gear, pulley and belt or other transmission member of the movement, according to the general arrangement adopted for the machine. For instance, a motorised means 9, indicated schematically on FIGS. 1 and 2, may be arranged on the fixed frame or on the chassis of each temper rolling equipment E, E' and connected removably to the active cylinder 2, 2', by a double-cardan telescopic extension 36 enabling to transmit the rotational torque while following all the positions of the axis of the active cylinder, according to the diameters of all its back-up members.

On the other hand, means easy to be designed enable to adjust the rotational speed of the active cylinders of both temper rolling units, while taking their diameters into account, in order to slave their peripheral speeds to the linear speed of the running band. This running speed may be measured at each moment, by a sensor 92, for instance from the rotational speed of the rolls of one of the tension blocks S which, as currently, are placed on both sides of the temper rolling machine in order to put the band under traction.

The arrangements which have just been described enable to provide a simple solution, relatively economical, to all above indicated problems and, in particular, to avoid the slipping effects risking of damaging the surface condition of the product, while facilitating the maintenance of the temper rolling equipment.

Indeed, since a rotational torque may be applied directly to one of the journals of each active cylinder, the angular speed thereof may be adjusted with precision and, in particular, slaved to the running speed of the band, so that both speeds are held identical at each moment.

Besides, the direct driving into rotation of each cylinder by a journal connected removably to the cylinder 2 facilitates the disassembly and the re-assembly of the cylinder.

Indeed, after having placed the whole temper rolling unit in its resting position, moved away from the band, it is possible, by simple rotation of the cams 8, to urge both supporting parts 4, 4' with the cylinder 2. Both supporting parts 4, 4' are then moved away axially in order to release the cylinder 2 which, in this position, is moved away from the intermediate rolls 7, 7' and may be withdrawn without any risk of damaging its surface.

After re-assembly of the active cylinder 2, the former is applied again to the intermediate rolls 7 and the rollers 70 by rotation of both cams 8. The assembly is clamped under load adjusted by the calibration of the springs 6.

The active cylinders 2 may then be brought into rotation and they drive by friction the intermediate rolls and the back-up rollers. When the synchronisation speed with the band is reached, the machine may be closed by placing both units E, E' in their temper rolling positions, the active cylinders thus coming in contact on the band without any slipping and without any risk of marking the product.

Moreover, even during the temper rolling process, by reason of the accurate control and of the possibility of slaving angular speeds of the active cylinders, the latter may be driven permanently at an angular speed corresponding to the running speed of the band, which enables to absorb speed variations of the temper rolling process without any risk of slipping, even for bands with small friction coefficient.

Obviously, the invention is not limited to the details of the embodiment which has just been described for exemplification purposes, whereas other variations may be contemplated without departing from the protection field of the invention.

Thus, equivalent means might be employed for the removable assembly of the journals of an active cylinder in their bearings, the sliding assembly of the latter, simultaneously in the axial direction and in the radial direction and the application of said cylinder on its back-up members.

In particular, the springs 6 might be replaced with other means. Besides, it should be noted that the application loads of the active cylinder are not the same for the lower equipment E and for the upper equipment E' whereof the weight should be compensated for. Therefore, as shown on FIG. 4, the chocks of the upper active cylinder are advantageously associated with two pairs of springs symmetric with respect to the radial plane P, on the one hand the springs 60 which exert only the application pressure necessary to drive into rotation the cylinder and the intermediate rolls, and on the other hand, two springs 65 which are calibrated in order to take up the weight of the active cylinder 2 with its two chocks 4, 4', its driving means 36 and, generally, all the members which are not carried directly by the chassis.

Besides, in a simpler embodiment, only the driving journal 3 might be connected removably to the end of the cylinder, the other journal remaining attached to the cylinder and able simply to engage axially in the internal roll stand of the corresponding bearing for the reassembly of the cylinder, the guiding foot of the part 4' supporting the bearing being then attached to the chassis.

The reference signs inserted after the technical characteristics mentioned in the claims, solely aim at facilitating the understanding thereof and do not limit the extent thereof.

The invention claimed is:

1. A machine for temper rolling a metal band including means for controlling the tension-adjusted running of the band according to a longitudinal direction and along a running plane, at least two temper rolling units placed on both sides of the band and including each an active cylinder and a set of back-up members rotatably mounted on a transversal chassis, around rotational axes parallel to one another and orthogonal to the running direction, and means for controlling the displacement of each temper rolling unit, parallel to itself, between a resting position for which the active cylinder is moved away from the band and a temper rolling position for which the active cylinder is applied to the band while bearing, on the opposite side, on its back-up members, whereas each active cylinder can be brought into rotation, before application to the band, at an angular speed corresponding substantially to the running speed of the band, wherein each active cylinder is carried, at each of its ends, by a centring journal mounted rotatably around the axis of the cylinder, on a supporting part mounted slidingly on the transversal chassis of the unit parallel to a radial plane running through the axis of said active cylinder, each supporting part of an active cylinder including a portion in the form of a box, a bearing mounted in said box rotatably supporting the corresponding journal of the active cylinder, centred on the radial plane, and an arm mounted to slide on a rail arranged on a guiding foot attached to the transversal chassis; wherein the positions with respect to said chassis of both supporting parts may be adjusted by radial sliding for the displacement of the active cylinder, parallel to its axis, between an application position on its back-up members and an away position; and wherein each active cylinder may be brought into rotation around its axis by direct application of a rotational torque on one of its centring journals.

2. A temper rolling machine according to claim 1, characterised in that each supporting sliding part is associated with a recall means bearing in one direction upon the supporting part and, in the opposite direction, on the transversal chassis, for the application of the active cylinder on its back-up members.

3. A temper rolling machine according to claim 2, characterised in that each supporting part includes a back-up means on the chassis to urge the active cylinder, against the action of the recall means, in an assembly and disassembly position for which the active cylinder is moved away from its back-up members or lies freely thereon.

4. A temper rolling machine according to claim 3, characterised in that the back-up means is a cam mounted rotatably around an axis and including a face bearing on the chassis by rotation round the axis, to urge the supporting part against the action of the recall means and a plane face adopting, by rotation of the cam, an away position of the chassis to enable application of the active cylinder on its back-up members by the recall means.

5. A temper rolling machine according to claim 1, characterised in that each supporting part includes a bearing portion fitted with at least one passage orifice of at least one guiding rod attached by a first end on the transversal chassis and extending, on the other side the bearing portion of the supporting part, up to a second end whereon is provided a bearing flange of a resilient recall means compressed between said flange and the bearing portion of the supporting part.

6. A temper rolling machine according to claim 5, characterised in that each supporting part is mounted slidingly radially on at least two guiding rods running each through an orifice of the bearing portion and associated each with a spring threaded on said rod and compressed between the bearing portion and a flange arranged at the end of the guiding rod.

7. A temper rolling machine according to claim 6, charaterised in that each guiding rod is formed of a socket threaded on a screw attached to the bearing portion of the supporting part and bearing on a flange arranged at the end of the socket opposite the bearing portion, a spring being threaded on the socket and compressed, by clamping the screw, between the flange and the bearing portion.

8. A temper rolling machine according to claim 7, characterised in that both supporting parts of the ends of each active cylinder are associated each with recall means which are calibrated in order to apply the active cylinder on its back-up members under a tension just sufficient for driving by friction said back-up members by the active cylinder.

9. A temper rolling machine according the claim 8, characterised in that both supporting parts of the active cylinder of the upper temper rolling unit are associated each with a first recall means calibrated for the application of the active cylinder on its back-up members and, besides, with a second recall means calibrated in order to compensate for the weight of the active cylinder, of its chucks and of the members which are not carried directly by the supporting chassis.

10. A temper rolling machine according to claim 1, characterised in that each supporting part carries a bearing for rotary centring of an end of an active cylinder, including at least a roller bearing with an external roll frame attached to the supporting part and a rotary internal roll frame, wherein is threaded a centring journal, attached to the corresponding end of the active cylinder and centred on the rotational axis thereof.

11. A temper rolling machine according to claim 1, characterised in that one of both journals attached respectively at both ends of the active cylinder, is extended outwardly by a driving end cap connected to a means for applying a rotational torque on the journal, for driving the cylinder, around its axis, at a requested angular speed.

12. A temper rolling machine according to claim 1, characterised in that at least the supporting part of the driving journal is mounted slidingly on a guiding foot which is itself mounted to slide on the transversal chassis, parallel to the axis of the active cylinder, between a clamped position of both supporting parts for engaging each end of the active cylinder, upon the corresponding supporting part and an away clearance position of the ends of the active cylinder, for the disassembly thereof.

13. A temper rolling machine according to claim 1, characterised in that at least the driving journal whereon is applied the rotational torque, is connected removably to the corresponding end of the active cylinder.

14. A temper rolling machine according to claim 13, characterised in that at least the driving journal includes an end of the shaft mounted rotatably on the supporting part and fitted with a removable linking means with the end of the active cylinder, said shaft end being movable axially, with the supporting part, between a clamped linking position with the cylinder, for the rotational support thereof and an away position, disconnected from the end of the cylinder, for the disassembly thereof.

15. A temper rolling machine according to claim 14, characterised in that the linking means between the journal and the cylinder is composed of two portions of matching shapes, laid out respectively on the shaft end and the corresponding end of the cylinder, and engaging into one another by axial displacement of the shaft end from an away position to a clamped position.

16. A temper rolling machine according to claim 15, characterised in that at least the guiding foot of the supporting part of the driving journal is attached to a base mounted slidlingly on the chassis parallel to the radial plane and associated with removable attachment means of the guiding foot on the chassis in the clamped engagement position of the ends of the active cylinder on the supporting parts.

17. A temper rolling machine according to claim 1, characterised in that the back-up members, of the active cylinder contain at least two cylindrical rolls mounted rotatably round their axis, each between two aligned centring members, laid out respectively on two guiding feet attached to the transversal chassis and whereon are mounted slidingly, respectively, both supporting parts of the active cylinder, parallel to a radial plane running through the axis of said active cylinder.

18. A temper rolling machine according to claim 17, characterised in that the centring members of each back-up roll are composed of two axial stops mounted respectively on the guiding feet of both supporting parts of the active cylinder.

19. A temper rolling machine according to claim 1, characterised in that the back-up members of the active cylinder of each temper rolling unit contain at least two intermediate rolls held laterally each between two axial stops and bearing each on at least two rows of rollers mounted rotatably on the transversal chassis.

20. A temper rolling machine according to claim 19, characterised in that each end of an intermediate roll is centred on an axial stop mounted in a casing with an extension housed in a recess arranged on a portion of the guiding foot, with a clearance enabling adjustment of the position of the intermediate roll relative to the diameters of the active cylinder and the back-up members.

* * * * *